US008616863B2

(12) United States Patent
Forsberg

(10) Patent No.: US 8,616,863 B2
(45) Date of Patent: Dec. 31, 2013

(54) ESP WITH OFFSET LATERALLY LOADED BEARINGS

(75) Inventor: Michael A. Forsberg, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 242 days.

(21) Appl. No.: 13/074,865

(22) Filed: Mar. 29, 2011

(65) Prior Publication Data

US 2012/0251362 A1 Oct. 4, 2012

(51) Int. Cl.
*F04B 17/03* (2006.01)
*E21B 43/00* (2006.01)
*F16C 32/06* (2006.01)

(52) U.S. Cl.
USPC ..... 417/423.13; 417/423.3; 417/423.12; 417/424.2; 166/105; 384/100

(58) Field of Classification Search
USPC ..... 417/423.12, 423.13, 423.3, 424.2; 166/105; 384/97, 100
See application file for complete search history.

(56) References Cited

U.S. PATENT DOCUMENTS

| | | | | |
|---|---|---|---|---|
| 4,240,683 | A | 12/1980 | Crase | |
| 4,984,173 | A * | 1/1991 | Imam et al. | 700/279 |
| 5,074,681 | A | 12/1991 | Turner et al. | |
| 5,772,334 | A * | 6/1998 | Parkins et al. | 384/117 |
| 6,099,271 | A * | 8/2000 | Brookbank | 417/423.12 |
| 7,008,108 | B2 * | 3/2006 | Wanger | 384/100 |
| 7,066,248 | B2 | 6/2006 | Howell | |
| 2004/0144534 | A1 | 7/2004 | Lee | |
| 2010/0098564 | A1 | 4/2010 | Parmeter | |

* cited by examiner

*Primary Examiner* — Charles Freay
(74) *Attorney, Agent, or Firm* — Bracewell & Giuliani LLP

(57) ABSTRACT

A submersible pumping system for use downhole, wherein the system includes a pump, a pump motor, a seal section, a shaft coupling the pump motor to the pump, and bearing assemblies for radially retaining the shaft in place that are offset with respect to an axis of the shaft. The offset bearing assemblies produce side loads in the shaft that reduce shaft vibration during use. The bearing assemblies can be a combination of symmetric and asymmetric assemblies set in an alternating pattern along the length of the shaft.

16 Claims, 5 Drawing Sheets

ESP WITH OFFSET LATERALLY LOADED BEARINGS

BACKGROUND

1. Field of Invention

The present disclosure relates to downhole electric submersible pump (ESP) systems that are submersible in wellbore fluids. More specifically, the present disclosure involves a method for controlling the loading applied to the radial bearings in an ESP to control the dynamic characteristics of the bearings in operation.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used employs an electrical submersible pump (ESP). ESPs are typically disposed at the end of a length of production tubing and have an electrically powered motor. Often, electrical power may be supplied to the pump motor via a cable. The pumping unit is usually disposed within the well bore just above where perforations are made into a hydrocarbon producing zone. This placement thereby allows the produced fluids to flow past the outer surface of the pumping motor and provide a cooling effect.

With reference now to FIG. 1, shown in a partial sectional view is a cased wellbore 8 having an ESP system 10 disposed therein. The ESP system 10 is made up of a motor 12, a seal 14, and a pump 16 and is disposed within the wellbore 8 on production tubing 18. Energizing the motor 12 drives a shaft coupled between the motor 12 and the pump section 16. The source of the fluid drawn into the pump comprises perforations 20 formed through the casing of the wellbore 10; the fluid is represented by arrows extending from the perforations 20 to the pump inlet. The perforations 20 extend into a surrounding hydrocarbon producing formation 22. Thus the fluid flows from the formation 22, past the motor 12 on its way to the inlets.

Traditionally, ESP systems 10 include bearing assemblies along the shafts in the motor section, seal section, and pump. Often, the bearings are plain sleeve bearings that provide radial support. One example of a bearing assembly provided in a motor section is provided in a cross sectional view in FIG. 2. Shown is a shaft 24 with an outer sleeve 26 that is circumscribed by a stator stack 28. The sleeve 26 couples to the shaft 24, such as by a key, and rotates along with the shaft 24. A housing 30 encases the outer circumference of the stator stack 28. A bearing assembly 32 is set between the outer sleeve 26 and stator stack 28 that radially encompasses a portion of the sleeve 26. The motor bearing assembly 32 may have an insert 34 mounted on the outer circumference of the sleeve 26; a bearing carrier 36 encircles the insert 34 and in the absence of an insert directly mounts on the shaft sleeve. A T-ring 38 may be included that mounts to the inner surface of the stator stack 28 for preventing bearing rotation. The sleeve 26, and therefore the shaft 24, is radially supported by the insert 34 or the bearing carrier 36. A lubricant film (not shown) allows for sleeve 26 rotation within the insert 34 or the bearing carrier 36.

Referring to FIG. 3, shown in a side sectional view is a prior art example of bearings in a pump section of an ESP system. Diffusers 40 are typically coaxially stacked in close contact within a housing 30. An impeller 42 is stacked between each successive diffuser 40, where each impeller 42 is coupled to and rotates with the shaft 24. Passages 44 curve radially and lengthwise throughout the diffusers 40 that register with passages 46 that similarly curve radially and lengthwise through the impellers 42. Rotating the shaft 24, and thus the impellers 42, forces fluid through the passages 44, 46 to pressurize the fluid as it passes along the stack of diffusers 40 and impellers 42. A sleeve bearing 48 couples around the shaft 24 to provide a bearing surface between the shaft 24 and inner circumference of the diffusers 40. As the shaft 24 rotates, a film of lubricating fluid is maintained between the bearing 48 and diffuser 40.

SUMMARY OF INVENTION

The present disclosure describes a method of controlling the loading of bearings in a submersible pumping system. In an example embodiment the method includes providing a submersible pumping system that has a pump section, a motor section, a shaft extending between the pump and motor sections, and a housing around the shaft and the pump and motor sections. Bearing assemblies are further provided that provide a bearing surface that allows rotation of the shaft and supports that mount the shaft in the pumping system. The bearing assemblies include a substantially symmetric bearing assembly and an asymmetric bearing assembly. The symmetric bearing assembly is disposed in an annular space between the housing and the shaft and substantially coaxial with the shaft. The asymmetric bearing assembly is disposed in the annular space and axially spaced from the substantially symmetric bearing assembly and with an axis of the asymmetric bearing assembly offset from an axis of the shaft. In this embodiment, when the shaft rotates within the symmetric and asymmetric bearing assemblies, a force between the shaft and the substantially symmetric bearing assembly in a direction divergent to an axis of the shaft to reduce vibration of the shaft. In an example embodiment, the substantially symmetric bearing assembly includes a sleeve having a bore that is coaxial with the sleeve. The asymmetric bearing assembly, in an example embodiment, is a sleeve having a bore with an axis that is offset from an axis of the sleeve. A rotor stack can be included with the submersible pumping system that mounts on the shaft, further included can be a stator stack set in the housing; the rotor and stator stacks can form the motor section. In an alternative embodiment, impellers are included with the submersible pumping system that are mounted on the shaft; in this alternative embodiment, diffusers can be set in the housing. The impellers and diffusers can form the pump section. The method may further include energizing the motor section so that the shaft and impellers rotate to pump fluid through the pump section. In another alternate embodiment, further provided are a multiplicity of substantially symmetric bearing assemblies and asymmetric bearing assemblies that are disposed on the shaft and in the housing. When the shaft rotates, the multiplicity of bearing assemblies exert a force onto a surface of the shaft and in a direction divergent from the axis of the shaft and wherein the direction of the force on adjacent bearing assemblies is substantially opposite. Optionally, when more than one substantially symmetric bearing assembly is provided, they can be disposed on opposite sides of the asymmetric bearing assembly.

Also described herein is a method of pumping fluid from a borehole. This method can include providing a submersible pumping system that has a pump section, a motor section, a shaft extending between the pump and motor sections, and a housing around the shaft and the pump and motor sections. The method further includes disposing the pumping system into a borehole with fluid and pumping the fluid from the borehole. Pumping includes energizing the motor section to rotate the shaft and drive the pump. In this example embodiment, bearing assemblies are provided at locations along an axis of the shaft and in an annular space between the shaft and the housing. Dynamic forces exerted by the bearing, as well as vibration in the shaft of the pumping system, can be reduced by generating a force between the shaft and each bearing assembly. Moreover, the force is in a direction divergent to an axis of the shaft; and in a direction divergent to a direction of the force generated by an adjacent bearing assembly. In an example embodiment, the bearing assemblies include substantially symmetric bearing assemblies that are made up of a sleeve with a coaxial bore. The bearing assemblies also include asymmetric bearing assemblies that include a sleeve with a bore having an axis offset from an axis of the sleeve. In an example embodiment, the bearing assemblies can be arranged so that a substantially symmetric bearing assembly is adjacent each asymmetric bearing assembly. Alternatively, the bearing assemblies can be arranged so that forces on the shaft from the bearing assemblies are applied at one of two locations on the outer surface of the shaft that are separated by approximately 180°. The submersible pumping system may have a rotor stack mounted on the shaft and a stator stack set in the housing; this arrangement forms the motor section. Optionally, impellers may be mounted on the shaft and diffusers can be set in the housing; this forms the pump section. In an example embodiment, the motor can be energized so that the shaft rotates and rotates the impellers to pump fluid through the pump section.

Yet further described herein is a submersible pumping system. In an example embodiment the pumping system includes a pump section, a motor section, a shaft extending between the pump and motor sections, and a housing encircling the shaft and the pump and motor sections. Included with the pumping system of this embodiment is a substantially symmetric bearing assembly set in an annular space between the housing and the shaft and positioned substantially coaxial with the shaft. The pumping system of this embodiment also has an asymmetric bearing assembly axially spaced from the substantially symmetric bearing assembly and positioned in the annular space with an axis of the asymmetric bearing assembly offset from an axis of the shaft. When the shaft is rotated, a force is generated between the shaft and the bearing assemblies in a direction divergent to an axis of the shaft that adjusts dynamic forces exerted by the bearing and reduces vibration of the shaft. In an example embodiment, the substantially symmetric bearing assembly includes a sleeve having a bore that is coaxial with the sleeve and the asymmetric bearing assembly includes a sleeve having a bore with an axis that is offset from an axis of the sleeve. A rotor stack may optionally be mounted on the shaft and a stator stack set in the housing to form the pump section. Impellers may also mounted on the shaft with diffusers set in the housing to form the pump section. The pumping system, in an example embodiment, may further include a multiplicity of substantially symmetric bearing assemblies and asymmetric bearing assemblies disposed in the annular space and wherein when the shaft is rotating, the multiplicity of bearing assemblies exert a force onto a surface of the shaft and in a direction divergent from the axis of the shaft and wherein the direction of the force on adjacent bearing assemblies is substantially opposite. In an alternate example embodiment, the bearing assemblies may be arranged to generate a force that increases vibration of the shaft.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
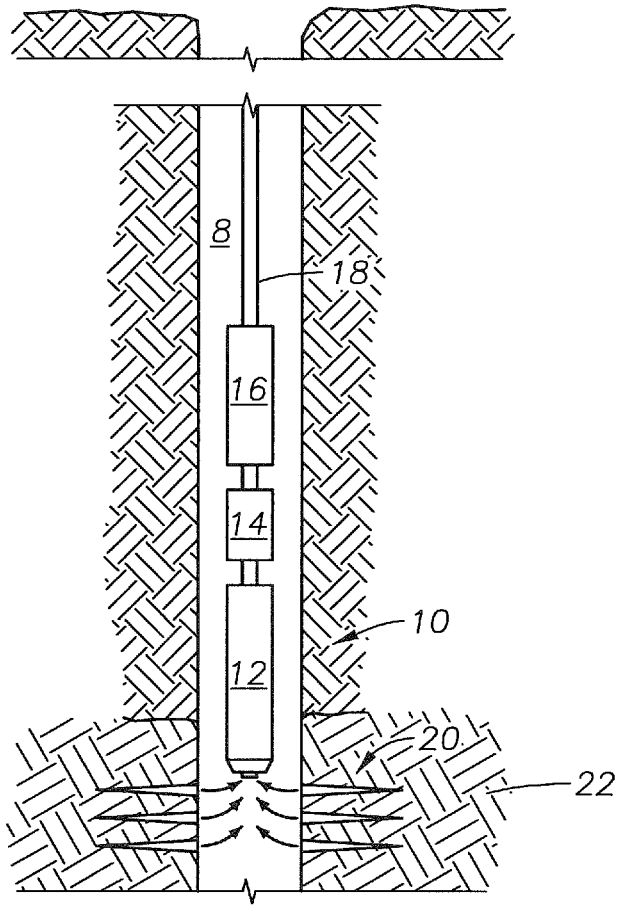
Fig. 1 (Prior Art)
FIG. 1 is a side partial sectional view of a prior art submersible pumping system disposed in a wellbore.
Figure 2:
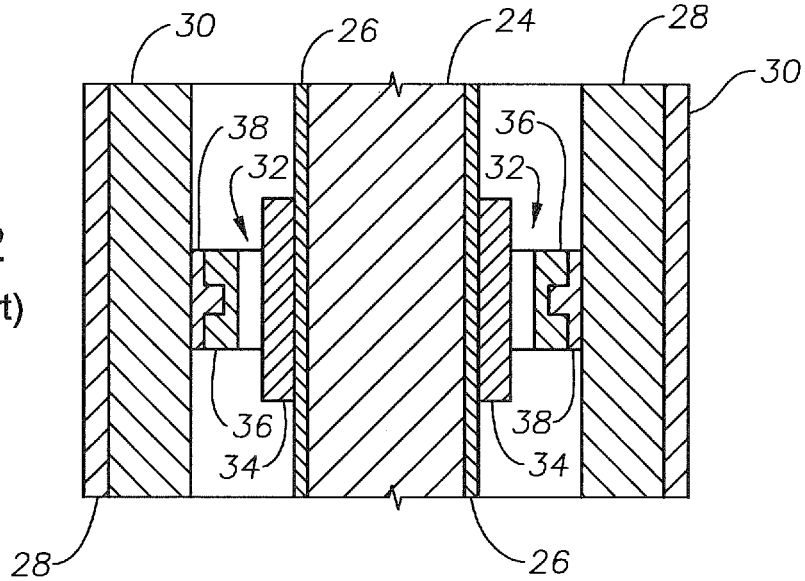
Fig. 2 (Prior Art)
FIGS. 2 and 3 are a side sectional views of prior art bearing systems for use in a submersible pumping system.
Figure 3:
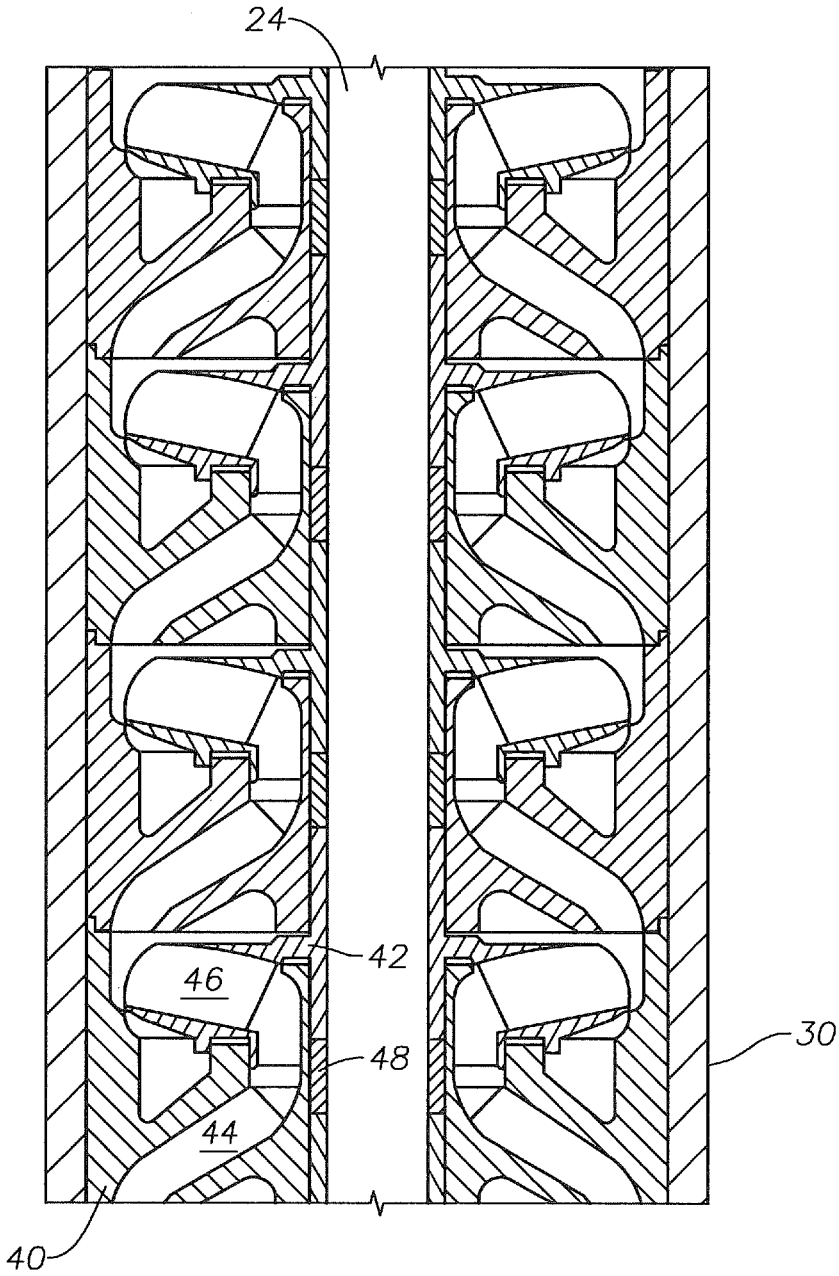
Fig. 3 (Prior Art)
Figure 4:
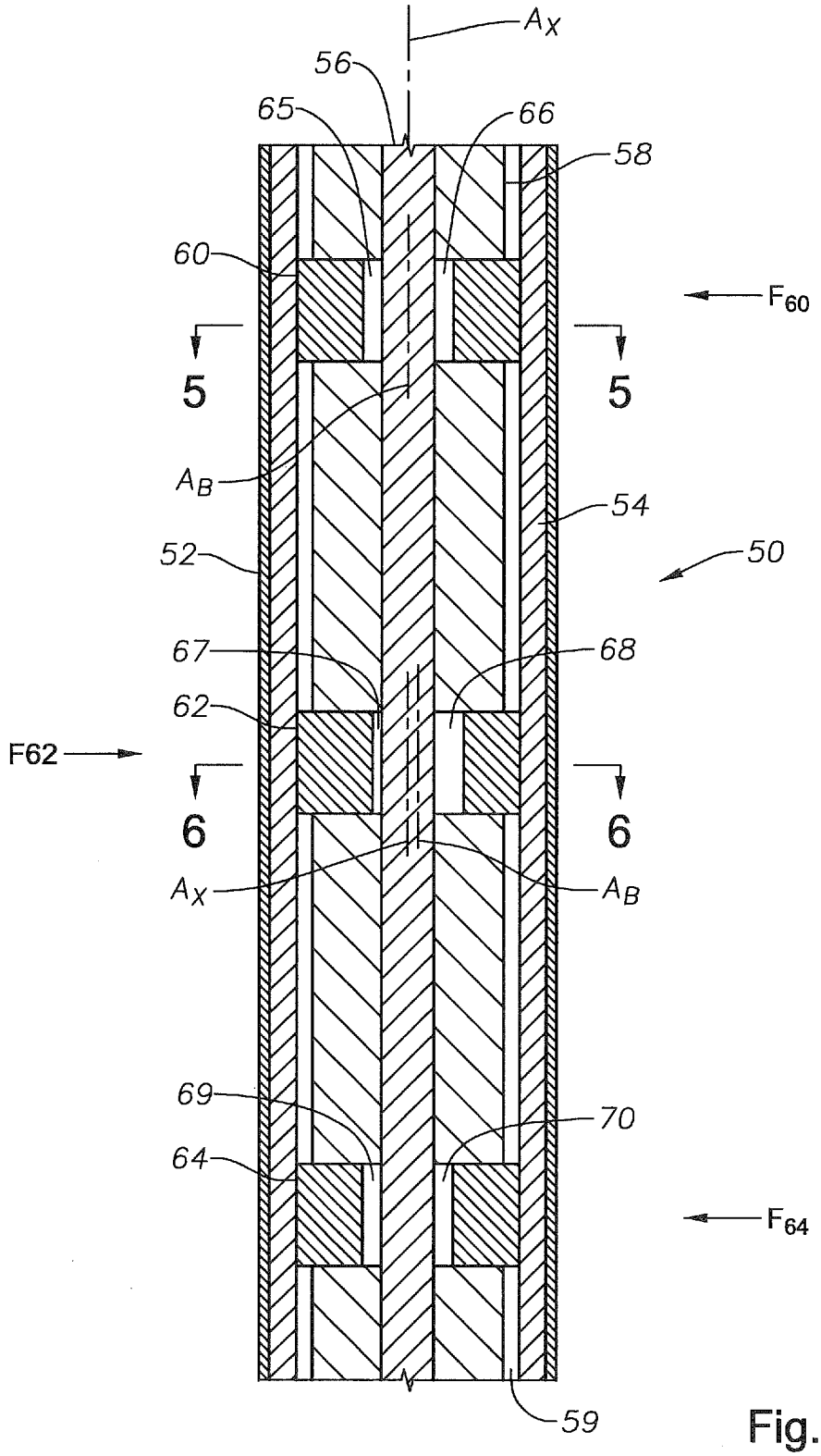
FIG. 4 is a side sectional view of an embodiment of bearing assemblies for use in a submersible pumping system in accordance with the present disclosure.

Referring now to FIG. 4, an example embodiment of an ESP assembly 50 is shown in a side sectional view. ESP assembly 50 includes an outer housing 52 that closely circumscribes an outer equipment stack 54. The outer equipment stack 54 is illustrated as an annular section and schematically represents equipment on the inner surface of the housing 52 that includes diffusers, such as illustrated in FIG. 3 above, or motor stators, as described and illustrated in FIG. 2 above. An elongate shaft 56 is shown within the ESP assembly 50 and substantially coaxial within the housing 52. The shaft 56 couples with an internal equipment stack 58 that is encircled by the outer equipment stack 54. The internal equipment stack 58 of FIG. 4 schematically represents equipment that includes impellers, such as illustrated in FIG. 3 above, or motor rotor sections, as shown in FIG. 2 above. The outer and internal equipment stacks 54, 58 define an annular space 59 between these two stacks 54, 58.

Example embodiments of bearing assemblies 60, 62, 64 are illustrated mounted within the internal equipment stack 58 that provide a bearing surface between the shaft 56 and mounting structure for retaining the shaft 56 within the ESP assembly 50. Bearing assembly 60 has a bore 65 through the assembly 60, an axis $A_B$ of the bore 65 is substantially coaxially with the axis $A_X$. The shaft 56 inserts through the bore 65 and defines an annular space 66 between the shaft 56 and outer periphery of the bore 65. The example embodiment of the bearing assembly 60 of FIG. 4 is shown with its bore 65 substantially coaxial with the remaining portion of the bearing assembly 60; and for the purposes of discussion herein, is referred to as a substantially symmetric bearing assembly. As such, the annular space 66 between the shaft 56 and outer periphery of the bore 65 has a substantially consistent clearance C (FIG. 5) for all angular values along the circumference of the shaft 56.

Figure 6:
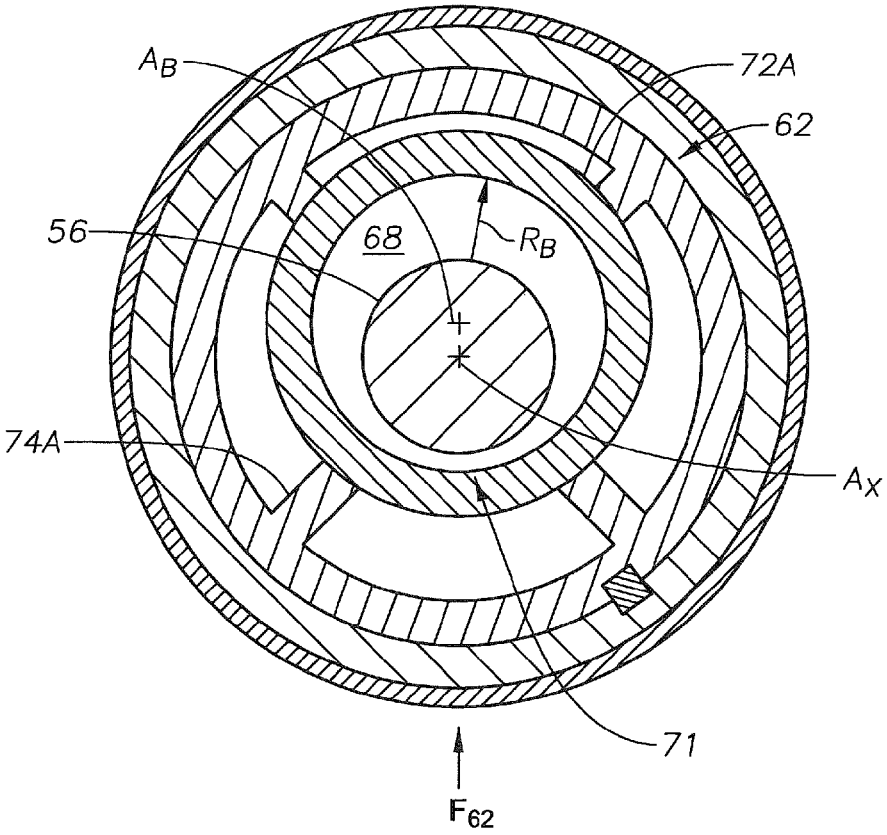
FIG. 6 is an axial sectional view of an offset bearing assembly of FIG. 4.

Still referring to FIG. 4, the bearing assembly 62 is illustrated axially disposed distance from the bearing assembly 60 and within the housing 52 and outer equipment stack 54 of the ESP assembly 50. The bearing assembly 62 is shown provided with a bore 67 having an axis $A_B$ substantially parallel to the axis $A_X$ and having the shaft 56 extending through the bore 67. The axis $A_B$ of the bore 67 is offset from the axis $A_X$ of the shaft 56. As such, an annular space 68 between the shaft 56 and outer periphery of the bore 67 has a clearance C (e) that varies with respect to the angular location on the outer circumference of the shaft 56 (FIG. 6). Moreover, in circumferential locations where the clearance of the annular space 68 is reduced, a resultant force $F_{62}$ is exerted onto the shaft 56 from the bearing assembly 62 and acts as a loading mechanism on adjacent bearings. The reduced clearance can reduce the amount of fluid film between the shaft 56 and periphery of the bore 67 to thereby form a side load onto the shaft 56 that is divergent from the axis $A_X$ of the shaft. In an example embodiment, the force $F_{62}$ is substantially perpendicular to the axis $A_X$.

The bearing assembly 64 illustrated in FIG. 4 has substantially the same dimensions and configuration as bearing assembly 60 and has a bore 69 formed to receive the shaft 56 therein and define the annular space 70 between the shaft 56 and outer periphery of the bore 69. The radius of the annular space 70 is substantially consistent around the circumference of the shaft 56. As noted above, a side load represented by $F_{62}$ is produced on the shaft 56 where it interacts with the bearing assembly 62 when rotated. Fluid dynamics of lubricating fluid within bearing assembly 60 and 64, in combination with the bearing assembly 60, 64, produce resultant forces $F_{60}$, $F_{64}$ to counter the side load of $F_{62}$. The applied side loads along the length of the axis 56, applied at varying angular positions on the outer circumference of the shaft 56, produce a more stable rotation of the shaft 56 and prevent excessive lateral movement within the respective bore 65, 67, 69 of the bearing assembly 60, 62, 64. As such, vibration during use of the ESP assembly 50 of FIG. 4 is substantially reduced by the disclosed configuration.

Figure 5:
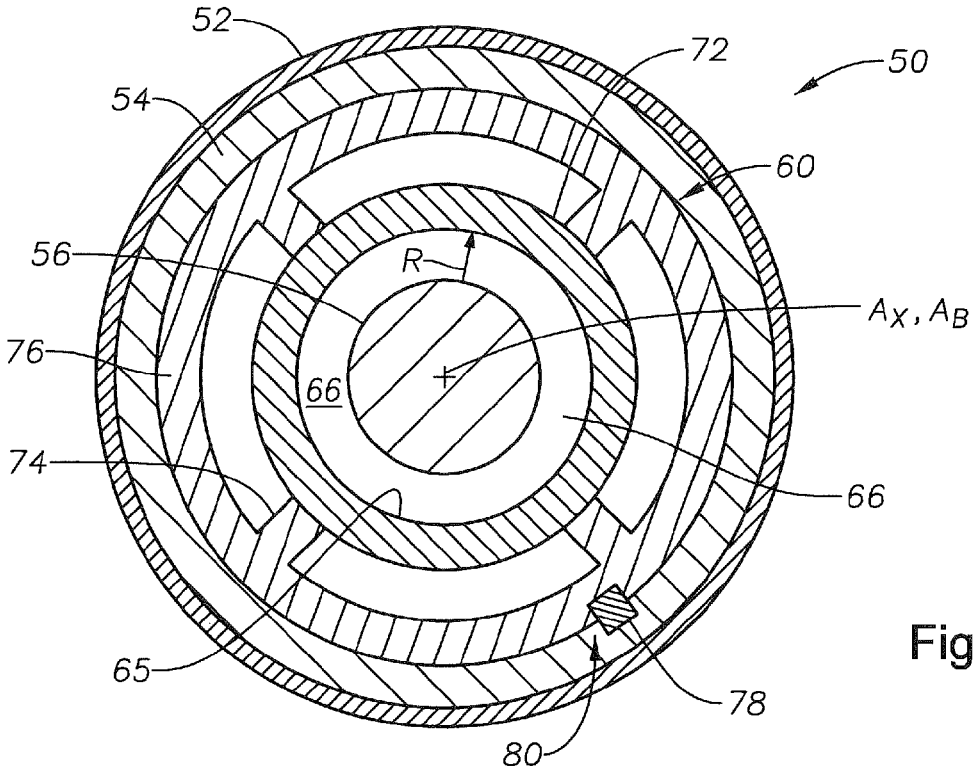
FIG. 5 is an axial sectional view of a centered bearing assembly of FIG. 4.

Referring now to FIG. 5, a sectional view of the ESP assembly 50 of FIG. 4 is shown in a sectional view taken along line 5-5 of FIG. 4. In the example embodiment of the bearing assembly 60 of FIG. 5, an annular sleeve 72 is shown within the bearing assembly 60 through which the bore 65 is formed. As illustrated in FIG. 5, the shaft 56 is generally centered within the bore 65 so that the axis $A_X$ and $A_B$ are substantially collinear. Further provided in the example of FIG. 5, are mount members 74 that extend radially inward from an outer ring 76 to the outer circumference of the sleeve 72.

Referring now to FIG. 6, an example embodiment of the asymmetric bearing assembly 62 is shown in a sectional view taken along line 6-6 of FIG. 4. As can be seen in this embodiment, the axes $A_X$ and $A_B$ are offset from one another. By being offset, the radius of the annular space 68 can vary depending on where on the circumference of the shaft 56 the radius of the annular space 68 is measured. Moreover, the radius of the annular space 68 can further vary depending on the particular design conditions of the ESP assembly 50. In an exemplary embodiment, the "offset" location 71 for each asymmetric bearing assembly 62, which corresponds to where the radius of the annular space 68 is at a minimum value, can be at the same angle with respect to the axis $A_X$. Optionally, the offset location 71 can alternate along the length of the shaft 56 and may be placed at designated angular locations. As noted above, in regions where the radius of the annular space 68 is reduced can generate a lateral side force $F_{62}$ and directed against the shaft 56.

Figure 7:
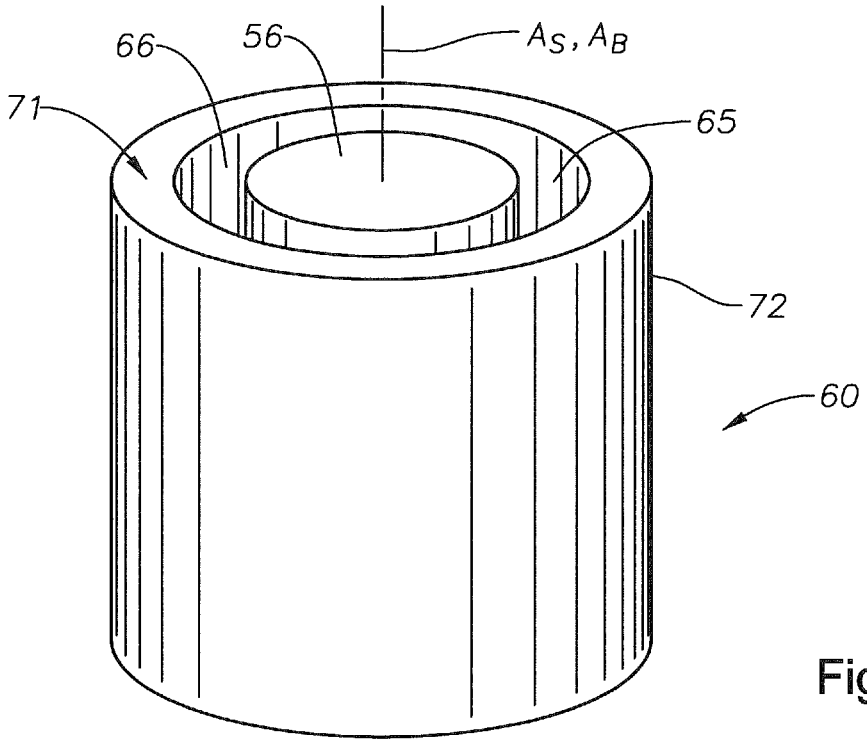
FIG. 7 is a side perspective view of a coaxially disposed shaft and bearing sleeve.
Figure 8:
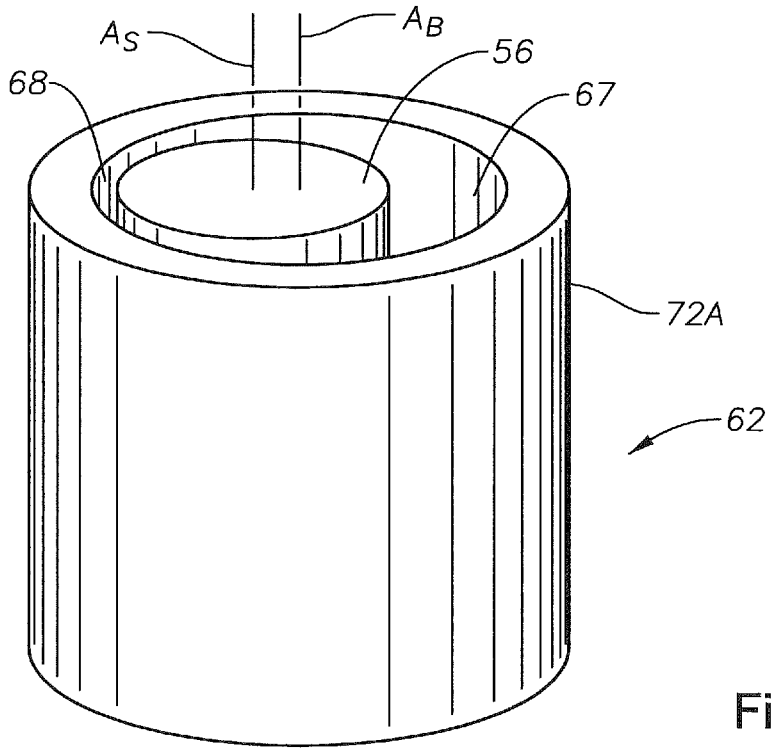
FIG. 8 is a side perspective view of a shaft set in an asymmetric bearing sleeve.

FIGS. 7 and 8 respectively depict perspective sectional views of the bearing assembly 60 and bearing assembly 62. In each of FIGS. 7 and 8, the shaft 56 extends through the respective bores 65, 67 of bearing assembly 60 and bearing assembly 62. Referring now to FIG. 7, the bore 65 is formed coaxial to the sleeve 72 with the bore axis $A_B$ coincident with the sleeve axis $A_S$; thereby providing a substantially even wall thickness around the circumference of the sleeve 72. In contrast and as illustrated in FIG. 8, the bore axis $A_B$, which is offset from the sleeve axis $A_S$, forms an asymmetric wall thickness of the sleeve 72A. In an alternative embodiment, the bore 67 may have a diameter that is greater than the diameter of the bore 65 in the symmetric bearing assembly 60.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Example alternative embodiments include configurations where the symmetric and asymmetric bearings sequentially alternate. In another embodiment, patterns of symmetric and asymmetric bearing assemblies placement are repeated; exemplary patterns can include one (or more) asymmetric bearing assembly(ies) between two symmetric bearing assemblies.

The invention claimed is:

1. A method of controlling the loading of bearings in a submersible pumping system comprising:

providing a submersible pumping system comprising a pump section, a motor section, a shaft extending between the pump and motor sections, a housing around the shaft and the pump and motor sections;

mounting at least one coaxial bearing in an annular space between the shaft and the housing, the coaxial bearing having a bore through which the shaft passes, the bore being coaxial with an axis of the shaft;

mounting at least one lateral force bearing in the annular space, the lateral force bearing having a bore through which the shaft passes, the bore of the lateral force bearing having an axis offset from the axis of the shaft, and fixing the lateral force bearing so as to prevent any radial movement of the lateral force bearing relative to the shaft; and filling the motor section with a lubricant liquid, immersing the pump section in well liquid and operating the pumping system so that when the shaft rotates within the coaxial and lateral force bearings, a liquid film occurs between the bearings and the shaft, and a lateral force is generated against the shaft by the lateral force bearing, which is reacted by the coaxial bearing in an opposite direction to the lateral force to reduce vibration of the shaft.

2. The method of claim 1, wherein the coaxial bearing and the lateral force bearing are located in the pump section, and the liquid film comprises the well liquid.

3. The method of claim 1, wherein the axis of the bore of the lateral force bearing is offset from an outer diameter of the lateral force bearing.

4. The method of claim 1, wherein the coaxial and lateral force bearings are located in the motor section, and the liquid film comprises the lubricant liquid.

5. The method of claim 1, wherein the coaxial and lateral force bearings are located both in the pump section and in the motor section.

6. The method of claim 1, further comprising providing at least two of the coaxial bearings and mounting the lateral force being axially between the two coaxial bearings.

7. A submersible pumping system comprising:

a pump section adapted to be immersed in a well liquid for pumping the well liquid;

a motor section filled with a lubricant liquid;

a shaft extending between and within the pump and motor sections;

a housing encircling the shaft and the pump and motor sections;

at least one coaxial bearing set in an annular space between the housing and the shaft, the coaxial bearing having a bore positioned substantially coaxial with the shaft;

at least one lateral force bearing axially spaced from the coaxial bearing and positioned in the annular space, the lateral force bearing being fixed against radial movement relative to the housing, the lateral force bearing having a bore with an axis offset from an axis of the shaft, so that when the shaft is rotated, a lateral force is generated between the shaft and the lateral force bearing assembly in a direction lateral to the axis of the shaft to reduce vibration of the shaft; and wherein during operation, a liquid film from at least one of the liquids occurs between the coaxial bearing and the shaft and between the lateral force bearing and the shaft.

8. The pumping system of claim 7, further comprising a stack of impellers mounted on the shaft and a stack of diffusers set in the housing to define the pump section, wherein the coaxial and lateral force bearings are located in the pump section, and the liquid film is adapted to be from the well fluid.

9. The pumping system of claim 7, wherein the bore of the lateral force bearing is eccentric relative to an outer diameter of the literal force bearing.

10. The pumping system of claim 7, further comprising a rotor stack mounted on the shaft having a plurality of rotor sections axially spaced apart and a stator stack set in the housing to form the motor section, wherein the coaxial and lateral force bearings are located between the rotor sections and in engagement with the stator stack, and the liquid film comprises the lubricant liquid.

11. The pumping system of claim 7, further comprising two of the coaxial bearings axially spaced apart from each other, the lateral force bearing disposed axially between the two coaxial bearings in the annular space and wherein when the shaft is rotating, each of the coaxial bearings exerts a reactive force onto a surface of the shaft and in a direction opposed to the direction of the lateral force imposed by the lateral force bearing.

12. A submersible pumping system comprising:

a pump section;

a motor section;

a shaft extending between and within the pump and motor sections;

a housing encircling the shaft and the pump and motor sections;

a coaxial bearing having a cylindrical bore that circumscribes the shaft and has a diameter larger than a diameter of the shaft to create an annular clearance of uniform radius between the shaft and an inner surface of the bore;

a lateral force bearing having a cylindrical bore that circumscribes the shaft and has a diameter larger than a diameter of the shaft to create an annular clearance between the shaft and an inner surface of the bore of the lateral force bearing, the annular clearance of the lateral force bearing varying around the shaft and being lesser on one side of the shaft than on an opposite side of the shaft;

wherein during operation, a liquid film is in the annular clearances of each of the coaxial and lateral force bearings, the lateral force bearing creating a laterally directed force that is reacted by the coaxial bearing-to reduce vibration; and wherein the lateral force bearing is mounted within the housing so as to prevent radial movement of the lateral force bearing relative to the housing.

13. The pumping system of claim 12, further comprising a stack of impellers mounted on the shaft and a stack of diffusers set in the housing to define the pump section, and wherein the coaxial bearing and the lateral force bearing are mounted in the pump section, and well liquid being pumped by the pump section provides the liquid film.

14. The pumping system of claim 12, further comprising a plurality of coaxial bearings and lateral force bearings along the shaft and arranged in an alternating pattern.

15. The pumping system of claim 12, wherein the bore of the lateral force bearing has an axis that is offset from an axis of an outer diameter sleeve of the lateral force bearing.

16. The pumping system of claim 12, wherein the submersible pumping system further comprises a rotor stack comprising a plurality of axially spaced apart rotor sections mounted on the shaft and a stator stack set in the housing to form the motor section, wherein the coaxial bearing and the lateral force bearing are located between the sections of the rotor stack and in engagement with the stator stack, and the liquid film comprises motor lubricant.

* * * * *

UNITED STATES PATENT AND TRADEMARK OFFICE

CERTIFICATE OF CORRECTION

PATENT NO. : 8,616,863 B2
APPLICATION NO. : 13/074865
DATED : December 31, 2013
INVENTOR(S) : Michael A. Forsberg It is certified that error appears in the above-identified patent and that said Letters Patent is hereby corrected as shown below:

In the Claims

Column 7, line 6, claim 6, delete “being” and insert --bearing-- before “axially”

Signed and Sealed this
Twenty-sixth Day of August, 2014

Michelle K. Lee

Michelle K. Lee
*Deputy Director of the United States Patent and Trademark Office*